US005628151A

United States Patent [19]

Monat

[11] Patent Number: 5,628,151

[45] Date of Patent: May 13, 1997

[54] MULTIPOCKET MEANS FOR HOLDING INSULATION TO PREVENT HEAT LOSS THROUGH AN ATTIC STAIRWELL

[76] Inventor: Alan N. Monat, 528 Starr Ridge Dr., Lake Wales, Fla. 33853

[21] Appl. No.: 339,754

[22] Filed: Nov. 15, 1994

[51] Int. Cl.[6] ..... E04F 19/08; E04F 11/04

[52] U.S. Cl. ..... 52/19; 52/72; 52/186; 52/202; 52/404.4; 49/463; 182/46; 182/77

[58] Field of Search ..... 49/463; 52/19, 52/72, 186, 200, 202, 309.9, 309.14, 404.4, 404.5, 406.2, 407.2, 407.3, 407.4, 407.5; 182/46, 47, 77

[56] References Cited

U.S. PATENT DOCUMENTS

| | | | |
|---|---|---|---|
| 3,729,879 | 5/1973 | Franklin | 52/406.2 |
| 4,151,894 | 5/1979 | Edwards | 52/200 X |
| 4,281,743 | 8/1981 | Fuller | 182/46 |
| 4,312,423 | 1/1982 | Helbig | 182/46 |
| 4,337,602 | 7/1982 | King | 52/202 |
| 4,344,505 | 8/1982 | Waters et al. | 182/47 |
| 4,541,208 | 9/1985 | Vesperman et al. | 52/19 |
| 4,550,534 | 11/1985 | Mariano et al. | 52/19 |
| 4,591,022 | 5/1986 | Sciambi et al. | 182/47 |
| 4,658,555 | 4/1987 | Steiner | 52/19 X |
| 4,832,153 | 5/1989 | Daw et al. | 52/186 X |
| 4,928,441 | 5/1990 | Daley | 52/19 |
| 4,944,126 | 7/1990 | King | 52/407.2 X |
| 5,271,198 | 12/1993 | Freeman | 52/202 |

OTHER PUBLICATIONS

"Wordless Workshop", *Popular Science Magazine*, Oct., 1980 (found in class 182, subclass 47).

*Primary Examiner*—Wynn E. Wood
*Assistant Examiner*—Kevin D. Wilkens
*Attorney, Agent, or Firm*—Herbert L. Gatewood

[57] ABSTRACT

Openings such as those for attic staircases may be covered with a multipocket member having top, side, and end pockets in which insulation can be placed. The side pockets are of longer length than the top pocket. When the side and end pockets are pivoted downwardly from the top pocket and provided in box-like configuration, the insulation at the pivot edges is compressed thereby filling up these edges.

3 Claims, 2 Drawing Sheets

MULTIPOCKET MEANS FOR HOLDING INSULATION TO PREVENT HEAT LOSS THROUGH AN ATTIC STAIRWELL

BACKGROUND OF THE INVENTION

1. Field of the Invention

This invention relates, in general, to a multipocket means for the holding of insulation to prevent heat loss through the stairwell for an attic pull-down foldable ladder. Further, it relates to an insulation means for location in the stairwell opening into the attic.

2. Description of Prior Art

Houses are commonly provided with a pull-down foldable ladder providing access to an attic. The opening or stairwell to the attic is provided with a spring-loaded closure which is pivotally mounted at one end. The foldable ladder is mounted to the top side of the closure and such offers support to the ladder when it is unfolded, the foot of the ladder resting on the floor of a hallway or a room. The closure is provided on the bottom side with a rope or other means for pulling the closure downwardly so that the ladder can be unfolded to provide access to the attic.

The closure is generally located between two joists whereby the ladder in its folded mode is located between the joists. Although insulation is commonly provided between the joists in the attic, for obvious reasons it is believed, the area surrounding and over the ladder is not. Moreover, it will be appreciated that the attic closure does not, in and of itself, provide a good seal with the opening in the attic floor. Thus, there is a crack through which hot air can be lost from the house in the winter and cold air in the summer, if the house is air conditioned. The heat loss through the stairwell, even though the area not provided with insulation is small, is considerable particularly in the colder climes. This, of course, results in greater heating bills. In the same manner, where the loss is cold air, particularly in the warmer climes, this leads to greater costs in providing an air conditioned home.

The problems resulting from a poorly sealed and uninsulated attic opening has been addressed heretofore by others. Exemplary of others proposed solutions to these problems are shown in U.S. Pat. Nos. 4,151,894; 4,344,505; 4,541,208; 4,550,534; 4,658,555; 4,832,153; and 4,928,441.

U.S. Pat. No. 4,151,894, which issued on May 1, 1979 discloses an insulating cover larger than and fitting over the opening in an upper floor such as an attic and an adjacent lower floor. The insulating cover is of a box-like configuration having an open bottom in which the foldable ladder is located and a closed top on which can be placed insulation. The insulating cover is provided with wheels so that it can be moved out of the way to allow access to the attic.

In U.S. Pat. No. 4,344,505 there is disclosed an insulation cap for disappearing stairwells comprising a rigid box-like structure of insulating material such as beads of foamed polystyrene. The top of the cap is mounted pivotally to the rectangular-shaped frame so that it can be raise upwardly to provide access to the attic.

The invention in U.S. Pat. No. 4,541,208 is directed to an insulating cover for the stairwell or opening in an attic floor. The cover is in the shape of an open-top inverted box-like structure providing a cavity in which the fold-up stairs can be located. The bottom edges of the side walls of the cover are each located in a U-shaped track so that the cover is slidable back to provide access to the attic and slidable forward to cover over the stairwell opening, when desired.

The insulating cover can be, according to the patentee, of glass fibers or other suitable plastic material.

U.S. Pat. No. 4,550,534 discloses a dome made of insulating material for an attic floor well opening in which is located a foldable stairway. The dome is of a box-like structure having an open top which is inverted to provide a cavity in which the stairs are located. The rectangular-shaped bottom is provided with weather stripping for providing a good seal between the dome and the perimeter of the well in the attic floor. The dome is spring-hinge mounted along one side so as to be pivoted upwardly when access to the attic is desired. The other side of the dome is provided with means for holding the dome down whereby the weather stripping is compressed providing a good seal. The hold-down means can be detached so that the dome will spring upwardly when access to the attic is desired.

U.S. Pat. No. 4,658,555 discloses an insulating cover or closure of an inverted box-like structure for an attic stairwell. The cover can be made of solid pieces of insulation such as cellular foam material. The outer surface of the cover can be provided with a reflective foil. The bottom edge defining the opening for the cover is provided with a sealing member such as a layer of glass fiber insulation. The insulating cover rests on a rectangular-shaped framework nailed to the top edges of joists which surround the stairwell opening.

U.S. Pat. No. 4,832,153 discloses an attic stair-well insulating cover which comprises a plurality of pieces that when fitted together form a cover in the shape of a rectangular box with four sides, a top and an open bottom. The pieces to be fitted together can be of rigid foam or glass fibers.

In U.S. Pat. No. 4,928,441 there is disclosed an open top box-like structure which is inverted providing a cavity for receiving foldable stairs and a cover for the stairwell opening. The cover comprises a strong central core of, for example, wood sandwiched between an outer and inner layer of molded glass fibers or other noninflammable plastic material. The cover hinge mounted along one side so that a person ascending the stairway can push the cover upwardly into an open position. When descending, the cover can be pulled downwardly into the closed position so as to enclose the fold-up stairs and provide a cover over the stairwell opening. A flexible sponge rubber layer is adhered to the underside or bottom edge of the cover to provide an air-tight fit against the surface of the attic floor while the weight of the cover presses down against it.

Although the stairwell covers disclosed in the above patents are satisfactory to some degree, their use is attendant with certain disadvantages. In general, the covers are either too heavy, or to bulky, or need somewhat extensive assembly. Furthermore, in some cases, the covers will not conform well to the unevenness of the attic opening. Also, of concern, is the fact that, because of the bulkiness of certain of the covers, a retailer is not likely to give up the space to handle such a product.

Thus, there is believed to be a need for a means to prevent heat loss through the opening for an attic folded stairway that is of simple construction, light weight, and easy to install. Further, there is need for an attic stairwell cover that conforms well to the stairwell opening, providing even better protection against the loss of heat from the room or hallway in which the attic stairway is located.

SUMMARY OF THE INVENTION

The present invention has as a major object the realization of a means for preventing heat loss through an attic stairwell that is not attendant with the problems now found with known insulating means for such a purpose.

Another object of the invention is to provide a multipocket means for holding insulation for preventing heat loss through the opening in the ceiling of a room and in the attic floor in which is located a foldable stairway.

A further object of the invention is to provide a multipocket means for holding insulation for preventing heat loss through a stairwell that is of simple and economical construction.

A still further object of the invention is to provide a multipocket means in the pockets of which can readily be placed insulation to provide an insulation means for preventing heat loss through an attic stairwell that is of light weight, and can be readily handled.

An advantage of the insulation means of the invention is that such can be easily provided and placed by hand over the stairwell or opening in the attic floor without need for tools of any kind.

A further advantage of the multipocket insulation means of the invention is that such is of light weight and can be easily put in position over the stairwell so that insulation means will be in place when the foldable ladder is to be folded and allowed to rise to its stored location.

Another advantage of the insulation means according to the invention is that such insulation means can readily be moved from its location over the stairwell when access is desired to the attic and set to one side on the attic floor.

Quite advantageously also, the multipocket means of the invention can be folded on itself and placed into a relatively small-size package of no more than about one square foot and only a few inches, e.g., about 2", in depth. Thus, the multipocket means for insulation is of a size that a merchant can more readily stock and keep on hand and will be given a reasonable amount of shelf space.

BRIEF DESCRIPTION OF THE DRAWINGS

For a better understanding of the present invention, reference should be made to the following detailed description of a preferred embodiment of the invention which is to be read in conjunction with the accompanying drawings, in which.

DETAILED DESCRIPTION OF THE INVENTION AND THE PREFERRED EMBODIMENTS THEREOF

Although the present invention will be described hereinafter with particular reference to the accompanying drawings, it is to be understood at the outset that it is contemplated that the present invention may be varied in specific detail from that illustrated and described herein while still achieving the desirable characteristics and features of the present invention. Accordingly, the description which follows is intended to be understood as a broad enabling disclosure directed to persons skilled in the applicable arts, and is not to be understood as being restrictive.

Figure 1:
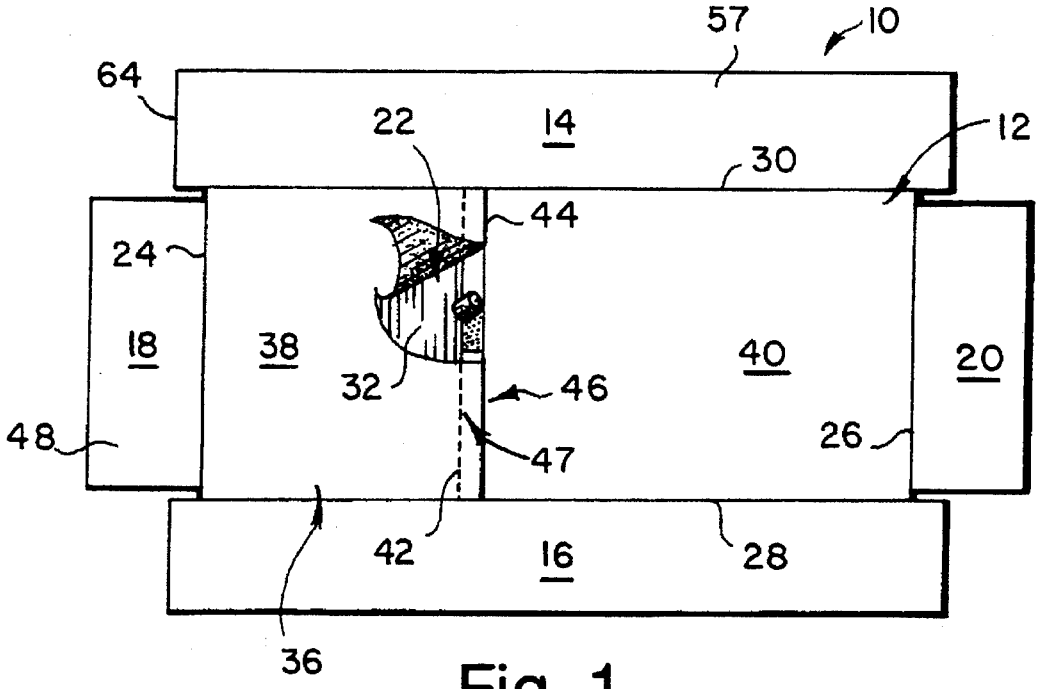
FIG. 1 is a top plan view of a multipocket means according to one aspect of the invention for holding insulation, to prevent heat loss through the opening in an attic floor in which a foldable ladder is located when not being used, the pocket in the top surface of the body member of the multipocket means being shown in a partial cutaway view and with the opening providing access to the pocket for the placement of insulation.
Figure 3:
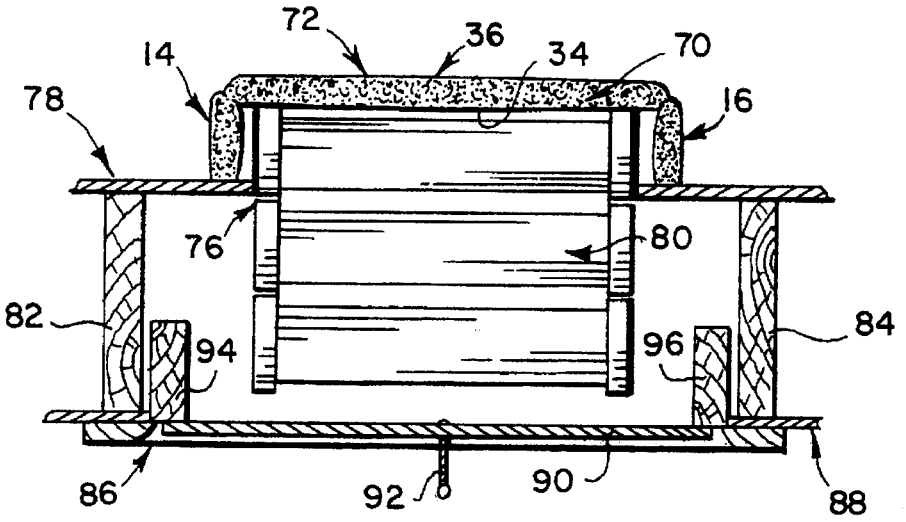
FIG. 3 is a cross-sectional view showing the foldable stair-way in the folded position when not being used and located between two joists with insulation having been placed in the pockets of the multipocket means according to the invention to provide an insulation means according to another aspect of the invention, the side and end members of the multipocket means shown in FIGS. 1, 2 having been folded and connected together in such a manner as to provide a box-like configuration with an open bottom and the insulation means being located over and covering the ladder and the opening in the attic floor.

Turning now to FIG. 1 of the drawings, there is shown in that figure a multipocket member or means 10 for holding insulation whereby insulation means can be provided for preventing heat loss through the opening in an attic floor in which a foldable ladder is conventionally located, as shown in FIG. 3, later to be more fully disclosed. The multipocket means 10 comprises a rectangular-shaped body member 12, side pocket members 14 and 16, and end pocket members 18 and 20, each of the side and end pocket members being fixedly and pivotally connected to the body member, to be further described hereafter. The side and end pocket members are also of rectangular shape as shown in the drawing.

The body member 12 comprises a bottom member 22 defined by spaced-apart, parallel end edges 24, 26 and spaced-apart, parallel side edges 28, 30, and by a top surface 32 and a bottom planar surface 34. The body member 12 further comprises a top, planar member 36 which, when assembled with the bottom member 22, is coextensive in length and width to the bottom member 22. The bottom and top members 22, 36 are fixedly connected together at their end and side edges. This can be accomplished by various conventional means depending somewhat upon the material chosen for the multipocket means. The top member 36 comprises two parts referred to in FIG. 1 by reference numbers 38, 40.

As will be appreciated from FIG. 1, the bottom and top members 22, 36 define a top pocket in the body member 12 for the holding of insulation, later more fully disclosed. The top member 36 is desirably of somewhat greater length than the bottom member 22 and is cut at a point between its ends prior to assembly with the bottom member 22 to provide the two parts 38, 40 defined by inner edges 42, 44 in parallel disposition to one another. The inner edge 44 overlaps inner edge 42 whereby to provide an elongated opening 46 for access to the top pocket for placement of insulation. An overlap is preferred so that the insulation, once placed in the pocket, will be prevented from dislodgment therefrom in handling.

Further, in the more preferred aspect of the invention, a length of tape 47 will be provided along edge 44, as shown in FIG. 1, on the underside of part 38 of the top member. Thus, the opposed faces of the overlapping edges can be secured together, once the insulation is placed in the top pocket 46. The length of tape 47 can be of a conventional double-faced pressure-sensitive adhesive tape, one layer of which is adhered to the underside of part 38 along the edge, the other adhesive layer being provided with a release layer until the tape is to be secured to the other edge, i.e., the edge of part 40. The opening 46, as shown in FIG. 1, is located somewhat closer to end edge 24 than end edge 26 of the body member 12 and extends from side edge 28 to side edge 30. This need not necessarily, however, be the case. The opening can be provided midway between the end edges 24, 26, if desired. Though somewhat less preferred, the two parts 38, 40 need not overlap and can, if desired, be of the same length. The opening into the top pocket of the body member can also be located at an end edge or side edge of the body member 12; however, this is much less preferred.

Figure 2:
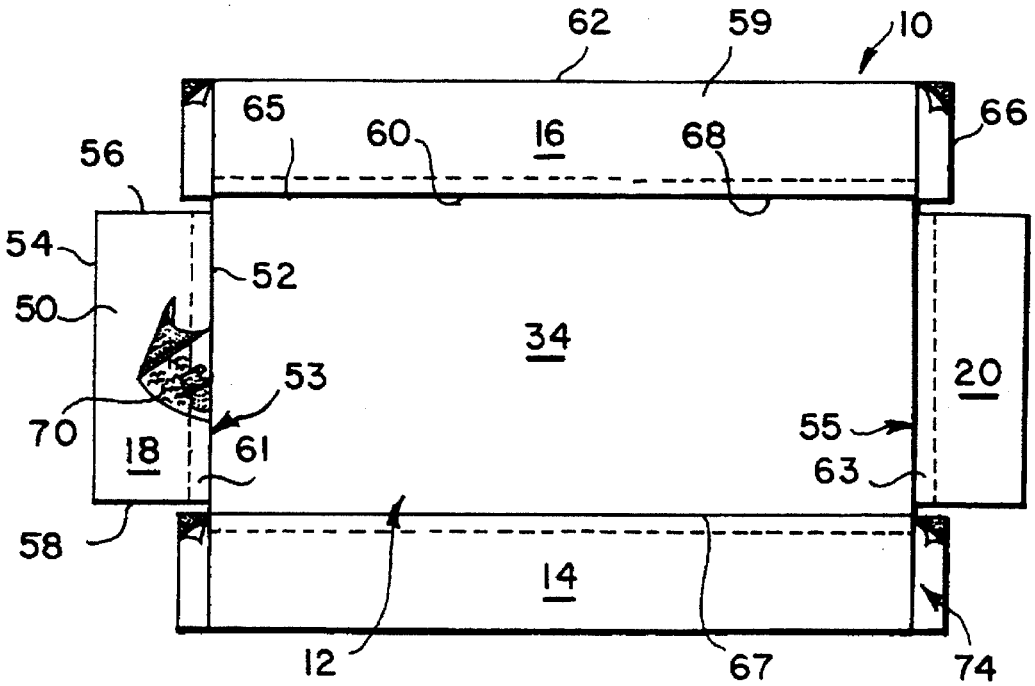
FIG. 2 is a plan view taken from the bottom of the multipocket means shown in FIG. 1 showing the openings providing access to the each of the side and end pocket members for the placement of insulation therein.

Referring now more particularly to FIG. 2, there is shown therein the bottom of the multipocket means 10 shown in FIG. 1. The end pockets 18 and 20 are of like construction and only end pocket 18 will be fully described herein. End pocket 18 is of rectangular shape and comprises a first top layer or panel 48 and a first bottom layer or panel 50, these panels being coextensive and defined by inner and outer spaced-apart end edges 52, 54 in parallel disposition to one another and by spaced-apart, parallel side edges 56, 58. These top and bottom panels are connected together at the outer end edges and the side edges. The inner end edge 52 of the top panel 48 is fixedly and pivotally connected to the body member 12 at its end edge 24, leaving only the inner end edge 52 of the first bottom panel free. Thus end pocket members are provided with elongated openings 53, 55 being provided so that insulation can be placed into the end pocket members without difficulty.

The top panels of the end pockets 18, 20 can be connected to the body member 12 in various ways, e.g., the top panels can be integral with the body member, such having been cut from a larger piece of material. Or, if desired, the top panels of the end pockets can be provided as separate members from the body member 12 and later assembled therewith. This can be done, e.g. by strips of adhesive tape or the like bridging the top panel inner edge and the end edges of the body member.

As will be seen from FIG. 2, the length of the inner and outer end edges 52, 54 of the end pocket members in the most preferred embodiment of the invention are of a somewhat lesser length then the respective end edge of the body member 12. The reason for this will soon be made clear. Thus, the side edges 56, 58 of the end pocket members are located inwardly from the side edges of the side pocket members (later described more fully) equidistantly. Although the end pocket members 18, 20 each comprises only one elongated pocket 53, 55, in the most preferred embodiment of the invention, the end pocket members 18, 20 can each be subdivided into two or more separate pockets, if desired. The end edges of the end pocket members can, if desired, be of the same length as the end edges of the body member 12. Nevertheless, such is much less preferred, as will be later more fully appreciated.

The side pocket members 14, 16 are of rectangular shape and of like construction. Accordingly, only side pocket member 14 is particularly described herein. As will be seen from FIGS. 1, 2, side pocket member 14 comprises a second top layer or panel 57 and a second bottom layer or panel 59. These panels are coextensive in length and width and are defined by spaced-apart, parallel inner and outer side edges 60, 62 and spaced-apart, parallel end edges 64, 66. The outer side edges 62 of the second top and bottom panels of the side pocket members are fixedly connected together, as are the end edges 64, 66 of these panels. The inner edge 60 of the second top panel is fixedly and pivotally connected to the side edges 28–30 of the body member 12. This can be accomplished in the same manner earlier disclosed in the case of the end pocket members. Thus, only the inner edge 60 of the second bottom panel is left free, providing an elongated mouth 68 allowing access to the side pocket members for the placement of insulation.

As seen from FIG. 2, the length of the inner side edge 60 of the side pocket member is of a somewhat greater length than that of the side edge 30 of the body member 12. This is most preferred in the practice of the invention. The reason for this will be later disclosed. Nevertheless, if desired, although less preferred, the side edges of the side pocket members can be of the same length as that of the body member 12.

Although one elongated pocket is preferred in each of the side pocket members, the pocket members can be divided into two or more smaller pockets, if desired. Importantly, as will be better appreciated later on, the openings for the end pockets and the side pockets are each located on the underside of the multipocket means 10, while the top pocket is located, instead, on the top side of the body member 12.

As in the case of the top pocket member in body member 12, the openings in the end and side pockets can be closed, once the insulation is placed into the pocket. This can be done by providing a length of double-faced pressure-sensitive tape such as indicated by reference numerals 61, 63 and 65, 67 along one or the other of the opposing panel faces, and along the inner side and end edges, of the side pockets and end pockets, respectively.

In providing an insulation means for preventing heat loss through an attic stairwell, insulation is placed in each of the pockets of a multipocket means 10 according to the invention. The preferred insulation to be used comprises conventional preformed nonwoven batting of glass fibers. This insulation is commercially available from any of various home building supply centers. The glass fiber insulation can be cut according to known techniques to provide rectangular-shaped blocks of the desired dimensions and shape to fit the various pockets provided in the multipocket means 10. An advantage in using such insulation is that it is not only flexible but is also easily compressed. The desirability of such a feature will soon be made clear. Nevertheless, though less preferred, other types of insulation can also be used, at least in some cases. For example, preformed blocks of foamed polystyrene or even loose insulating material.

Once the insulation shown generally by reference numeral 70 in FIG. 3 of the drawing is placed in all the pockets of the multipocket means 10 of the invention, the side pocket members and end pocket members are each then pivoted downwardly, i.e., in a direction opposite from the top pocket, in preparation to providing an insulation means 72, in accordance with another aspect of the invention. This is accomplished, in general, by connecting an end edge of a side pocket member to a side edge of an end pocket member. Thus, there is formed a box-like structure defined by four sides members, a top member, and an open bottom in which the ladder, when folded, is located, as will be appreciated by reference to FIG. 3.

The connection of the end edges of the side pocket members and the side edges of the end pocket members can be readily accomplished by various techniques known to those skilled in the art. Preferably, however, connecting these edges together can be easily accomplished by use of elongated strips of conventional double-faced pressure-sensitive adhesive tape, strips of such being provided on the bottom surface of the bottom side panel and along the end edges of the panel. This is made possible by the fact that the side pocket members are of greater length than the side edges of the body member 12. This extra length provides a location for placement of a length of pressure-sensitive adhesive tape. Although these lengths of tape are provided along the end edges of the side pockets, this need not necessarily be the case. The strips of tape can be provided on the top panel adjacent the side edges of the end pocket members, instead, if desired. In this case, however, the width of the end pockets will be greater than the end edges of the body member 12. And, the side pocket members will be of lesser length than the side edges of the body member.

When the end and side pocket members are pivoted downwardly from respective side and end edges of the body member 12, the side edges of the top panels of the end pocket members 18, 20 will, importantly, be in opposition to the end edges of the bottom panels of the side pocket members, in overlapping manner. This is because the side edges of the side pockets are of greater length than the side edges of body member 12. At this time, the release paper is stripped from the double-faced tape 74 and the edges of the opposed end pockets and side pockets are pressed together to form the insulation means 72 of the invention, as will be appreciated from FIG. 4 of the drawing. The insulation means 72 has the shape of a box with a closed top end and an open bottom end. Thus, a cavity is provided for the location of the ladder when it is folded up and not being used. If desired, the corners of the insulation means can be strengthened by application of an adhesive strip to, and bridging, the end edges of the top panel of the side pocket and the top panel of the end pockets.

When the end and side pocket members are pivoted downwardly and the edges thereof are connected together to form the insulation means 72, the edges of the nonwoven glass fiber insulation 70 in the pockets shift and are compressed together. Importantly, this shifting and compressing of the insulation where the end and side pockets are pivoted downwardly and connected together causes the corners formed to be filled with insulation. This results from the greater length of the side edges of the side pockets and the end edges of these pockets overlapping the side edges of the end pockets, due to the length of the end edges of the end pockets being less than the end edges of the body member. As the insulation in the pockets is prevented from moving, due to the end and side pockets being closed, the same result occurs in the pivot locations. The side edges of the insulation in the side pockets are compressed as are the side edges of the body member, and the insulation in these pockets shift somewhat causing the pivot corners to be filled with insulation as shown in FIG. 3. Although not shown, the same result occurs where the end pockets are pivoted. In this case, and this is a critical feature of the preferred invention, an insulation means 72 is provided having better insulating properties than one where the corners of the insulation means are not compressed and do not mate together so that the corners are filled with insulation.

The pressure-sensitive adhesive tape can be provided along the end edges of the bottom panels of the side pockets as shown in FIG. 2. Thus, when the release layer is stripped the pressure-sensitive adhesive 74 will be placed in contact with the side edges of the top panels of the end pockets. On the other hand, if desired, the double-faced tape 74 can be located along the end edges of the top panels of the side pockets. In this case, the bottom side panel edge of the side pocket will be attached to the edge of the top panel of the end pocket. No matter how the edges of the side and end pockets are connected together, the important consideration is that the insulation provided in the pockets is caused to be shifted and compressed when the end and side pockets are pivoted downwardly and the opposed edges are connected together, resulting in these pivot edges and connecting edges being filled with insulation.

The multipocket means of the invention can be provided of various conventional materials, e.g., glass fiber reinforced plastic sheets, spunbonded materials, polyester film, and cloth. Nevertheless, the most preferred material is TYVEK spun bonded material commercially available from DuPont. This material has high strength and is of light weight. The various layers and panels disclosed earlier can be readily cut from a wide sheet of the material and easily assembled together. Connecting the edges of the various members and panels together, as earlier disclosed, can be accomplished by various means; however, an adhesive composition or pressure-sensitive adhesive tape is preferred. A suitable adhesive or tape can be selected by those skilled in the pertinent art, such a selection depending somewhat upon the material of construction.

As an alternate means of providing a multipocket means according to the invention, the top panels forming the end and side pocket members and the bottom layer for the top pocket member can be provided from a single sheet of material. In this case, a rectangular-shaped sheet of suitable size will be provided and a shape such as shown in FIG. 1 will be cut therefrom. The sheet of material provided, e.g., a sheet of TYVEK olefin spun bonded material must be large enough to leave, after the end and side panels are provided, a bottom member 22 for the body member 12 of the required length and width. Another sheet of the same dimensions as the bottom member will then be cut out of the sheet of material to provide a top member of two parts, as earlier disclosed, for the body member and such will then be connected at its edges to the respective edges of the bottom member to provide a top pocket. Then, bottom panels for the end and side pockets can be provided of the same dimensions as the top panels, these latter panels being integral with the body member 12 and the ends and side edges connected in the manner earlier disclosed to provide the end and side pocket members. In this manner of construction, the inner edges of the end and side pocket members and the point at which such are pivotally connected to the body member will be defined by an imaginary line connecting the end edges of the side pocket member and the side edges of the end pocket members, respectively.

Although the invention disclosed in detail herein, as shown in FIG. 1, shows the end pocket members to be shorter than the end edges of the body member and the side pocket members to be longer than the side edges of the body member 12, this need not necessarily be the case. The same result can be accomplished if the end pocket members are longer than the end edges of the body member and the side pocket members are shorter in length than the side edges of the body member 12.

In still another embodiment of the invention, the top panels of the end and side pocket members can be of somewhat greater length or width, as the case may be, than the respective bottom panels. Thus, when the outer end and side edges of the pocket members are connected together, the construction will have the appearance of a rectangular-shaped envelope with a flap provided with adhesive. The extra length of the top panel members or flap will, in this case, provide a means by which the pocket members can be pivotally connected to the edges of the body member 12.

Although as shown in FIG. 2, and earlier disclosed, double-faced pressure-sensitive tape is provided along the end edges of an assembled side pocket, this need not be necessarily the case. The top panel of the side pocket can, if desired, be somewhat longer than the bottom panel. Thus, when the bottom panel is assembled with the top panel, a rectangular-shaped free area will be left for location of the double-faced tape.

Figure 4:
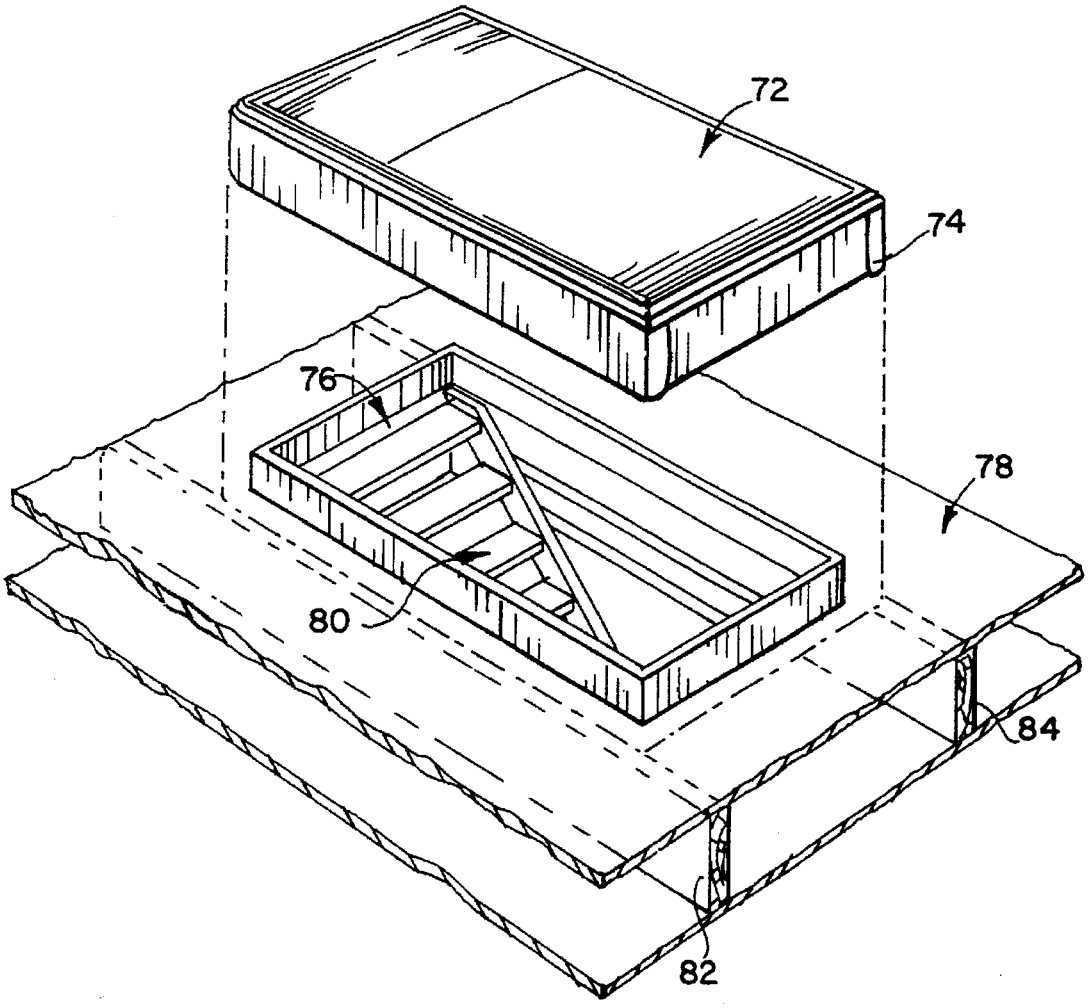
FIG. 4 is an exploded perspective view showing in part the attic floor and the opening or stairwell between adjacent joists for gaining access to the ceiling with the insulation means shown in FIG. 3 being raised upwardly so that it can be set aside allowing access to the attic and showing the foldable ladder being unfolded for use in gaining access to the attic.

The insulation means 72 is of relatively light weight and can readily be located in place to seal off the elongated, rectangular-shaped opening 76 as conventionally provided in an attic floor 78 for the location of a foldable ladder 80, when such is in the folded mode, as can be seen from FIG. 3. Such an opening is provided in the attic floor between joists 82, 84 as shown in FIG. 3, a like opening 86 being provided in the ceiling 88 for location of the rectangular-shaped stairwell door or closure 90. The foldable ladder 80 is connected in usual fashion to the closure 90 so that when the closure is pulled downwardly by the pull chain 92 the ladder unfolds as shown in FIG. 4. Thus, to gain access to the ceiling one need merely raise the insulation means 72 upwardly and set it to one side on the attic floor adjacent the opening 76. This can be readily done by hand, due to the light weight of the insulation means.

When one exits from the attic, the insulation means 72 is merely placed over the opening in the attic floor so that the ladder will be located therein when folded up, as shown in FIG. 3. After placing the insulation means 72 in place, the ladder 80 is folded up in usual manner and caused to rise upwardly by a conventional spring-loaded mechanism (not shown) taking with it the closure 90. The closure 90 is stopped from rising further when the edges of the inside surface of the closure contacts the stop members 94, 96 located in the stairwell opening.

As will be understood by those skilled in the applicable art, various modifications and changes can be made in the invention and its particular form and construction without departing from the spirit and scope thereof. The embodiments disclosed herein are merely exemplary of the various modifications that the invention can take and the preferred practice thereof. It is not, however, desired to confine the invention to the exact construction and features shown and described herein, but it is desired to include all such as are properly within the scope and spirit of the invention disclosed and claimed.

What is claimed is:

1. Multipocket member for holding insulation for preventing heat loss through the opening in an attic staircase comprising a rectangular-shaped body member of predetermined length and width defined by a planar top member and a planar bottom member, said body member terminating in parallel, spaced-apart end edges and parallel, spaced-apart side edges, a top pocket being provided by the top and bottom members for the holding of insulation, an opening being provided in the top member providing access to the top pocket whereby preformed insulation of predetermined size and shape can be inserted in the top pocket, said opening in the top member of the body member being located between the end edges of the body member and extending from one side edge of the body member to the other, side pocket members each comprising a top and bottom panel having a rectangular shape being defined by inner and outer side edges parallel to one another, the inner side edges of each said top panel of a side member being pivotably connected to the body member at respective side edges, the inner side edge of the bottom panel of each said side pocket member being free thereby defining an elongated pocket for the holding of insulation, and rectangular-shaped end members comprising a top panel and a bottom panel each defined by inner and outer end edges in parallel disposition to one another, the inner end edges of the top panels of the said end pocket members being pivotably connected to the body member at respective end edges, the inner end edges of the bottom panels of said end pocket members each being free thereby defining an elongated pocket for the holding of insulation.

2. Multipocket means according to claim 1 wherein the top member of the body member is provided in two parts each being defined by an inner edge located between the end edges of the body member, the inner end edges of the two parts of the top member being in overlapping relationship to one another.

3. Multipocket means for the holding of insulation to prevent heat loss through an opening in an attic floor in which is located a folding stairway comprising a rectangular-shaped, planar body member defined by a bottom surface and a top surface and by parallel, spaced-apart end edges and parallel, spaced-apart side edges, and by top and bottom members coextensive in length and width, a top pocket being provided by said top and bottom member of the body member coextensive in length and width with the body member for the holding of insulation, an elongated opening being provided in the top member of the body member providing access to the top pocket, said opening being located between the end edges of the body member and extending from one side to the other, rectangular-shaped side pocket members each being defined by a top panel member and a bottom panel member coextensive therewith, each of said top and bottom panel members being defined by spaced-apart, parallel outer and inner side edges of a predetermined length greater than the length of the side edges of the body member and spaced-apart, parallel end edges, the inner side edge of each of said top panel members being pivotally connected to the respective side edges of the body member, the end edges of the top and bottom panel members being connected together and the outer side edges of the top and bottom panel members being connected together, the inner side edge of the bottom panel member being free whereby to provide at least one opening for at least one pocket in each said side pocket member for the holding of insulation, end pocket members of rectangular shape each being defined by a top panel member and by a coextensive bottom panel member, each of said top and bottom panel members being defined by spaced-apart, parallel outer and inner end edges and spaced-apart, parallel side edges, the outer end edges of the top and bottom panel members being connected together and the side edges of the top and bottom panel members being connected together, the inner end edge of each of the top panel members being pivotally connected to respective end edges of the body member and being of a predetermined length somewhat less in length than said end edges of the body member, the inner end edge of the bottom panel member being free whereby to form at least one opening for at least one pocket in each of the end pocket members for the holding of insulation, connection means being provided on at least one or the other of the side pocket members and the end pocket members adjacent at least one of the end edges and side edges whereby upon pivoting of the side and end pocket members downwardly in the direction of the bottom surface of the body member the facing end and side edges are fixedly connected together whereby to provide a box-like structure having an open bottom end and a closed top end.

* * * * *